US009435563B2

(12) United States Patent
Einhorn

(10) Patent No.: US 9,435,563 B2
(45) Date of Patent: Sep. 6, 2016

(54) RECHARGEABLE BACKUP ELECTRIC HEATING SYSTEM FOR POWER OUTAGES

(71) Applicant: Elinor Einhorn, Rockaway, NJ (US)

(72) Inventor: Elinor Einhorn, Rockaway, NJ (US)

( * ) Notice: Subject to any disclaimer, the term of this patent is extended or adjusted under 35 U.S.C. 154(b) by 28 days.

(21) Appl. No.: 14/520,437

(22) Filed: Oct. 22, 2014

(65) Prior Publication Data

US 2015/0292769 A1 Oct. 15, 2015

Related U.S. Application Data

(63) Continuation-in-part of application No. 14/250,170, filed on Apr. 10, 2014, now abandoned.

(51) Int. Cl.

| | |
|---|---|
| ***H05B 3/00*** | (2006.01) |
| ***F24H 3/04*** | (2006.01) |
| ***F24H 9/20*** | (2006.01) |
| ***H05B 1/02*** | (2006.01) |

(52) U.S. Cl.

CPC ..... *F24H 3/0417* (2013.01); *F24H 9/2071* (2013.01); *H05B 1/0277* (2013.01)

(58) Field of Classification Search

CPC .... F24H 3/00; F24H 3/002; H01M 2220/30; H02J 7/0013; H02J 7/0054

USPC ..... 320/103; 392/347–378

See application file for complete search history.

(56) References Cited

U.S. PATENT DOCUMENTS

| | | | | |
|---|---|---|---|---|
| 1,582,709 | A * | 4/1926 | Vaughan | 392/434 |
| 3,610,882 | A * | 10/1971 | Omohundro | 392/376 |
| 4,948,951 | A | 8/1990 | Balzano | |
| 5,135,359 | A | 8/1992 | Dufresne | |
| 6,480,672 | B1 * | 11/2002 | Rosenzweig et al. | 392/365 |
| 2008/0240689 | A1 * | 10/2008 | Coke | 392/367 |
| 2008/0260364 | A1 * | 10/2008 | Vandrak et al. | 392/365 |
| 2010/0051709 | A1 * | 3/2010 | Krichtafovitch | B03C 3/08 236/36 |
| 2011/0262114 | A1 | 10/2011 | Montgomery | |
| 2011/0285343 | A1 | 11/2011 | Weng | |

FOREIGN PATENT DOCUMENTS

| | | | |
|---|---|---|---|
| DE | 102011005646 | A1 * | 9/2012 |
| EP | 244880 | B1 | 7/1990 |

* cited by examiner

*Primary Examiner* — Dana Ross
*Assistant Examiner* — Brandon Harvey
(74) *Attorney, Agent, or Firm* — Thomas J. Germinario

(57) ABSTRACT

A rechargeable backup electric heating system includes a rechargeable portable electric heater, multiple rechargeable battery packs, a rapid recharging circuit, and one or more high capacity storage batteries, from which the battery packs are recharged. The rechargeable portable electric heater has a design power output of P watts, which is determined by the BTU/hr of heat output required to maintain a target temperature in living space under prevailing outdoor temperature conditions. There are n sets of rechargeable battery packs, each having a weight of B kg. At any given time, one of the battery packs is within or attached to the heater and serving as its source of electric power, and (n−1) battery packs are being recharged by the storage battery through the recharging circuit.

4 Claims, 2 Drawing Sheets

RECHARGEABLE BACKUP ELECTRIC HEATING SYSTEM FOR POWER OUTAGES

REFERENCE TO RELATED APPLICATION

The present application is a Continuation-in-Part of U.S. patent application Ser. No. 14/250,170, filed Apr. 10, 2014.

FIELD OF THE INVENTION

The present invention relates to the field of rechargeable electric heating systems, and more particularly to rechargeable backup electric heating systems which are designed to become activated during power outages.

BACKGROUND OF THE INVENTION

With the increasing frequency and duration of extreme weather events, the need to provide for losses of electrical power over extended periods has become a necessity for both homes and businesses. In the absence of backup generators, electric power outages result in shutdown of oil and gas-fired heating systems that rely on electrical ignition. During severe weather, when such shutdowns are most likely to occur, the absence of heat for extended periods poses a massive public health threat, particularly to the young, elderly and infirm.

For many families and businesses, installation of a backup gasoline or gas-fired generator is either impractical or unaffordable. Kerosene and propane heaters are bulky and generate unhealthy vapors, as well as posing fire hazards. Portable plug-in electric heaters are clean, relatively safe, and affordable, but they rely on the power grid for their energy. (As used herein, the term "electric heater" designates a heater in which electrical energy is directly converted into heat by one or more resistive heating elements.) While very small battery-powered heaters are available for heating articles of clothing, the large amount of energy demanded for space heating is far beyond the capacity of such systems.

To maintain a 300 square-foot (sq-ft) area at room temperature in temperate winter conditions, for example, requires about 5000 BTU/hr, which equates to nearly 1500 watts (W) of electrical power. Therefore, to heat this 300 sq-ft room for 12 hours demands 18,000 watt-hours (Wh) or 18 kilowatt-hours (kWh) of electrical energy. The amount of energy that a battery can provide before being recharged or replaced is determined by the size/weight of the battery and its energy density. So a rechargeable nickel-cadmium (Ni—Cd) battery weighing one kilogram (kg) and having an energy density of 50 Wh/kg can provide 50 Wh of electrical energy before needing a recharge. This means that a portable heater powered by five such Ni—Cd batteries would have to be recharged every 10 minutes to keep a 300 sq-ft room comfortably warn in winter weather.

In recent years, however, there has been rapid development in battery technology, particularly as applied to electric powered motor vehicles, with the aim of attaining energy densities comparable to those of gasoline (13 kWh/kg). Lithium-ion (Li-Ion) batteries, for example, can have energy densities as high as 250 Wh/kg, so that 5 kg of such batteries could furnish the electrical energy to heat a 300 sq-ft room for nearly an hour before needing to be recharged. Even more advanced metal-air batteries, such as lithium-air and zinc-air batteries, which are currently under development, can attain energy densities in the range of 2000-3000 Wh/kg. As described in the U.S. patent application of Lee et al. (2013/0330639), which is incorporated herein by reference, a lithium air battery designed by Samsung Electronics Co., Ltd., has an energy density of over 3000 Wh/kg, so that 5 kg of such batteries could provide the electrical energy to heat a 300 sq-ft room for 10 hours before needing a recharge.

SUMMARY OF THE INVENTION

Using high-energy-density rechargeable batteries, an exemplary battery-powered backup electric heating system can be configured as follows:

Assuming a 3-hour battery recharge cycle, a 5 kg weight limit per battery pack, and 3 sets of battery packs, each battery pack would have to last 1.5 hours to sustain the 1500 W design power output indefinitely (or, more accurately, up to the limit of recharging cycles the batteries could sustain). This requires a minimum energy capacity of 2250 Wh per 5 kg battery pack, which equates to an energy density of 450 Wh/kg.

In the absence of electrical power from the grid, electrical energy for battery recharging would be provided by a set of three storage batteries that would be kept fully charged while the grid was up. Each storage battery would provide 2250 Wh of energy over 3 hours, which is a power output of 750 W, or a charge rate of 37.5 amperes (A) at 20 volts (V). At 80% recharging efficiency, this requires a minimum storage battery capacity of 140.6 ampere-hours (Ah). If necessary, the storage batteries would be periodically recharged during the power outage from an automobile battery or other available electric power source.

Generalizing from the foregoing example, the rechargeable backup electric heating system of the present invention comprises a rechargeable portable electric heater, multiple rechargeable battery packs, a rapid recharging circuit, and one or more high capacity storage batteries, from which the battery packs are recharged.

The rechargeable portable electric heater has a design power output of P watts, which is determined by the BTU/hr of heat output required to maintain a target temperature in a living space under prevailing outdoor temperature conditions. The rechargeable battery packs comprise n sets or packs, each having a weight of B kg, such that, at any given time one of the battery packs is within or attached to the heater and serving as its source of electric power, and (n−1) battery packs are being recharged by the storage battery through the recharging circuit.

P=design heater power (W)

B=battery pack weight (kg)

n=number of battery packs

If $t_r$ is the time required to recharge each battery pack, then the minimum discharge time $t_d$ for each battery pack is $$t_d=t_r/(n-1)$$

and the minimum required energy density E (Wh/kg) for each battery pack is $$E=(t_d \times P)/B$$

If the efficiency of the recharging circuit is $r_e$ %, and the storage battery voltage is V, then the minimum storage battery capacity S (Ah) is $$S=P \times t_r/[(n-1) \times V \times r_e]$$

Depending on the type of secondary cells comprising the rechargeable battery packs and the storage batteries, complete discharge in each cycle may not be feasible, as it would shorten the battery life. If the batteries have an allowable depth of discharge of $d_r$ % for the rechargeable battery packs, and $d_s$ % for the storage batteries, then the required energy density E (Wh/kg) from each battery pack is $$E=(t_d \times P)/B \times d_r$$

and the required storage battery capacity S (Ah), per battery pack recharge, is $$S=P \times t_r/[(n-1) \times V \times r_e \times d_s]$$

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
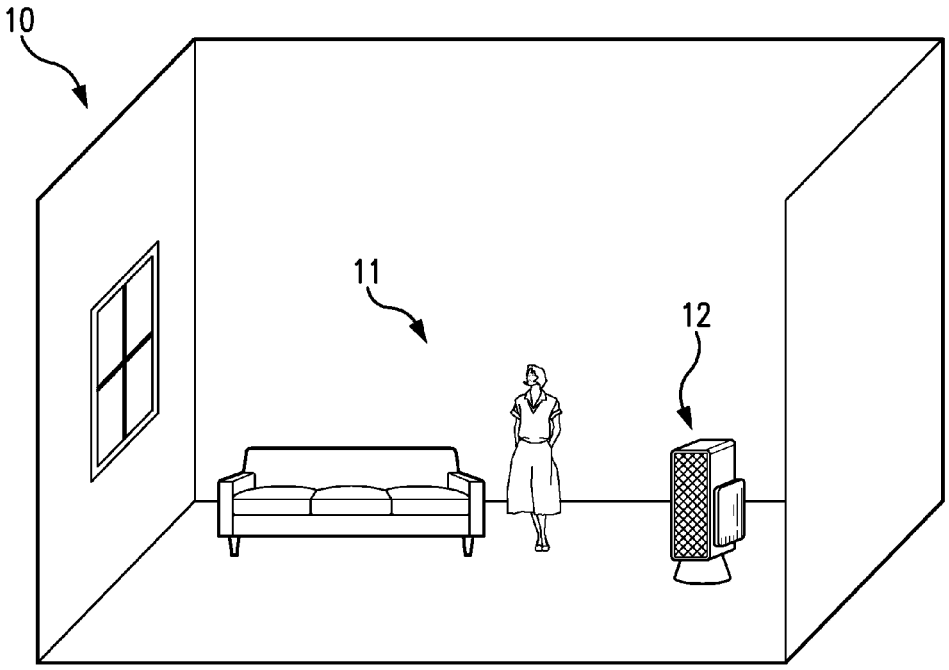
FIG. 1 is a cutaway perspective view of an exemplary embodiment of the present invention applied to heating a living space.

Referring to FIG. 1, an exemplary embodiment of the present invention 10 is used to heat a 300 sq-ft living space 11. A heat output of 4777 BTU/hr is required to maintain a comfortable room temperature under the ambient weather conditions, which translates to 1400 W of electric heater power output.

Figure 2:
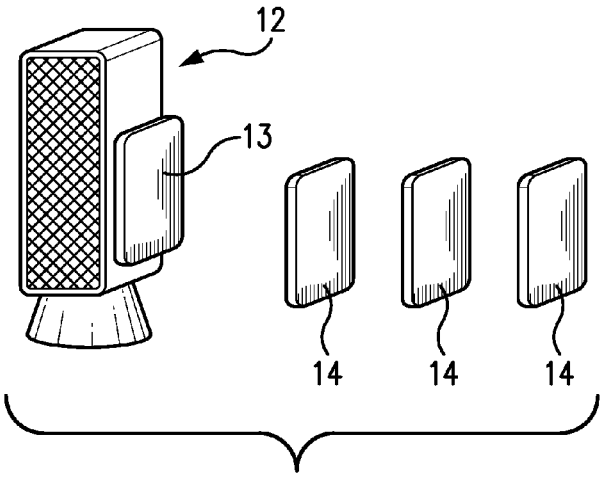
FIG. 2 is a detail perspective view of a rechargeable portable electric heater with a rechargeable battery pack and three reserve battery packs according to the exemplary embodiment of the present invention.

A 1500 W rechargeable portable electric heater 12, adjusted to an output of 1400 W, is used to heat the 300 sq. ft. space 11. Referring to FIG. 2, the heater 12 is powered by a 7 Kg Li-Ion battery pack 13, with an energy density E of 250 Wh/Kg. If the allowable depth of discharge $d_r$ of the battery pack is 80%, then its discharge time $t_d$ will be $$\begin{aligned} t_d &= E \times B \times d_r / P \\ &= 250\ \text{Wh/Kg} \times 7\ \text{Kg} \times .80 / 1400\ \text{W} \\ &= 1\ \text{hr} \end{aligned}$$

The exemplary heating system 10 has a total of n such Li-Ion battery packs 13, so that there a n−1 reserve battery packs 14 that can be recharging while the first battery pack 13 is discharging as it powers the heater 12. Consequently, the maximum recharge time $t_r$ per battery pack, in this example, is $$t_r=(n-1)t_d=(n-1)hrs$$

Figure 3:
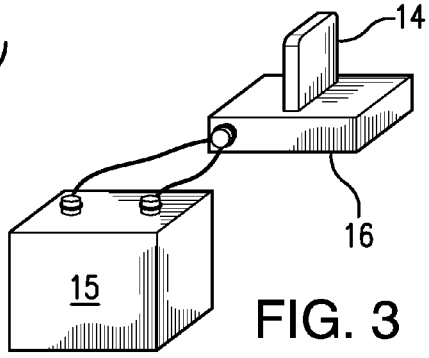
FIG. 3 is a detail perspective view of a storage battery and recharging circuit used to recharge a rechargeable battery pack according to the exemplary embodiment of the present invention.

Referring to FIG. 3, the recharging of the battery packs is accomplished by one or more Li-Ion storage batteries 15 through one or more recharging circuits 16, such as that disclosed in the U.S. patent application publication of Culp (2014/0042959), which is incorporated herein by reference. If the recharging circuit 16 has an efficiency $r_e$ of 80%, and if the storage battery 15 operates at 20V with an allowable depth of discharge $d_s$ of 90%, then the requisite capacity S (Ah) of the storage battery can be computed:

$$\begin{aligned} S &= P \times t_r / [(n-1) \times \mathrm{V} \times r_e \times d_s] \\ &= 1400\ \text{Wh}/20\ \text{V} \times .80 \times .90 \\ &= 97.2\ \text{Ah per battery pack recharge} \end{aligned}$$

In this exemplary heating system 10, there are a total of four battery packs 13, with three battery packs in reserve 14, so that the maximum recharge time is $$t_r=(n-1)=3hrs$$

In order to provide for 8 hours of continuous heating, assuming that each battery pack 14 starts off with a full charge, two storage batteries 15 would need to have sufficient capacity for two battery pack recharges each, so that each would have a capacity of 194 Ah. A further extension of heating hours could be accomplished by recharging the storage batteries from power provided by a motor vehicle, generator or other available power source.

Figure 4:
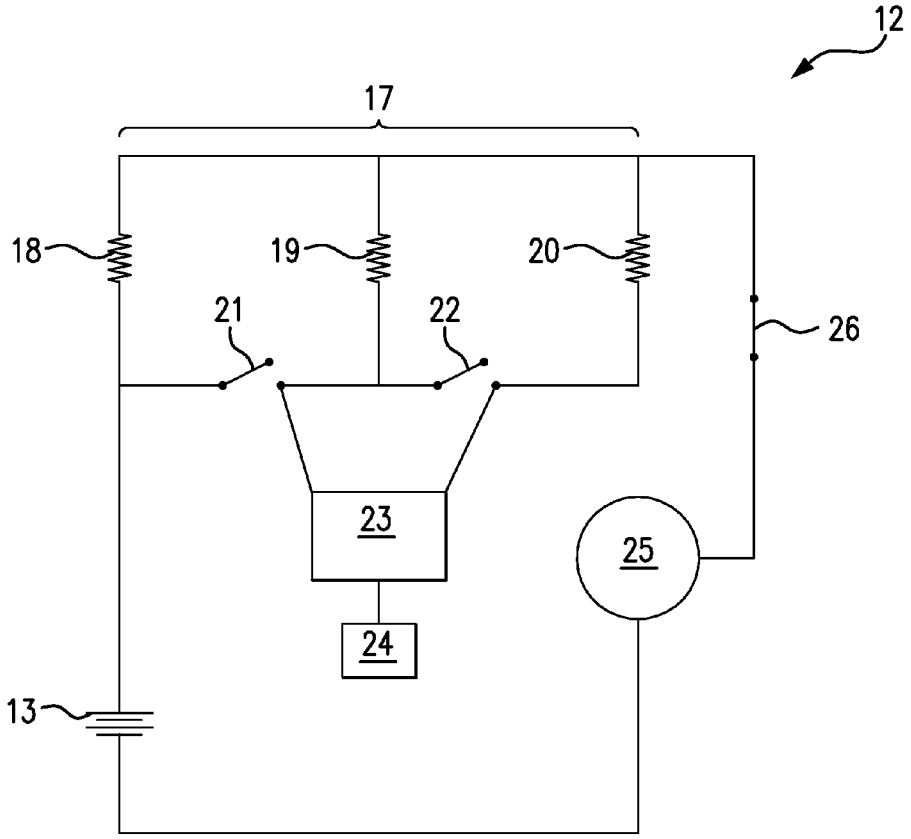
FIG. 4 is a circuit diagram of an exemplary rechargeable portable electric heater with variable heat output features.

In order to extend battery discharge time, it is advantageous to provide means by which the heat output of the heater 12 can be varied in response to ambient temperature in the heated space 11. One example of how this can be done is illustrated in FIG. 4. The heat output is generated by multiple resistive heating elements 17, which have a high electrical resistance producing heat as current passes through them. In this example, there are three resistive heating elements: a first resistive heating element 18, a second resistive heating element 19, and a third resistive heating element 20.

Electrical power in this exemplary heater circuit 12 is provided by the rechargeable battery 13. The second 19 and third 20 resistive heating elements are energized, respectively, by a first switch 21 and a second switch 22. The opening and closing of these switches 21 22 is controlled by a microprocessor 23, based on input from a temperature sensor 24 and a temperature set point for the heated space 11. A manually-actuated overall on/off switch 26 can also be provided.

In this illustration, the energizing of only the first resistive heating element 18, with both switches 21 22 open, would correspond to a "low heat" setting. The energizing of both the first 18 and second 19 resistive heating elements, with the first switch 21 closed and the second switch 22 open, would correspond to a "medium heat" setting, while the energizing of all three resistive heating elements 17, with both switches 21 22 closed, would correspond to a "high heat" setting. By way of example, the microprocessor 23 could be programmed to implement the "low heat" setting if the temperature sensor 24 registered a room temperature more than 5° F. above the set point. If the temperature sensor 24 registered a room temperature more than 5° F. below the set point, the microprocessor 23 would implement the "high heat" setting. For room temperatures within 5° F. of the set point, the microprocessor 23 would implement the "medium heat" setting.

The exemplary heater circuit 12 also includes a variable-speed fan 25 for circulating air heated by the resistive heating elements 17. The speed of the fan 25 increases in proportion to the voltage drop across the fan 25. Since the resistive heating elements 17 are arranged in parallel, their combined resistance $R_T$ will decrease as the heat output is increased. Assuming that all three resistive heating elements 17 have the same resistance $R_H$, then their combined resistance $R_T$ at the "high heat" setting will be $R_H/3$, as compared to $R_T$ at the "medium heat" setting equal to $R_H/2$, and $R_T$ at the "low heat" setting of $R_H$.

Since the combined resistance $R_T$ of the resistive heating elements 17 decreases with increasing heat output, and because the variable speed fan 25 is in series with their combined resistance $R_T$, the voltage drop across the fan 25, and hence the fan speed, will increase with increasing heat output and will decrease with decreasing heat output, so that fan speed is correlated with heat output. Therefore, the exemplary circuit of FIG. 4 illustrates one method by which the battery energy consumed by the heater 12 and fan 25 can be adjusted in response to room temperature so as to extend the battery's discharge time.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A rechargeable backup electric heating system for use in a heated space during a power outage, comprising:

a rechargeable portable electric heater, having two or more resistive heating elements and powered by one or more rechargeable batteries, wherein the two or more resistive heating elements are arranged in parallel, and wherein one or more switches are controlled by a microprocessor to regulate energization of one or more of the resistive heating elements based on temperature data from a temperature sensor, which monitors a room temperature in the heated space, and wherein the microprocessor is programmed to increase a number of the resistive heating elements that are energized and constitute parallel energized heating elements in response to the temperature data from the temperature sensor indicating the room temperature which is a defined decrement below a selected temperature set point, and wherein the microprocessor is programmed to decrease the number of resistive heating elements that are energized and constitute parallel energized heating elements in response to the temperature data from the temperature sensor indicating the room temperature which is a defined increment above the selected temperature set point;

a variable speed fan, which operates at a fan speed proportional to a fan voltage drop across the variable speed fan, and wherein the parallel energized heating elements have a combined resistance that varies inversely to the number of parallel energized heating elements, and wherein the variable speed fan is in series with the combined resistance of the parallel energized heating elements, such that the fan voltage drop and the fan speed increase as the number of parallel energized heating elements increases, and such that the fan voltage drop and the fan speed decrease as the number of parallel energized heating elements decreases;

one or more rapid recharging circuits, each of which is electrically connectible to one or more of the rechargeable batteries so as to provide a rapid recharging electrical current to each of the rechargeable batteries; and one or more rechargeable storage batteries, each of which is electrically connectible to one or more of the recharging circuits so as to provide a rapid recharging electrical current to each of the recharging circuits.

2. The heating system according to claim 1, wherein, while one or more of the rechargeable batteries are active batteries powering the electric heater, one or more rechargeable batteries are reserve batteries which are electrically connected to one or more of the storage batteries through one or more of the recharging circuits, such that the reserve batteries are fully charged and able to replace the active batteries when the active batteries are discharged.

3. The heating system according to claim 2, wherein each of the rechargeable batteries have an energy density E, measured in watt-hours per kilogram (Wh/Kg), based on a discharge time $t_d$ of the rechargeable battery in hours (hr), and also based on a design heater power output P in watts (W), equal to: $E=(t_d \times P)/B \times d_r$; wherein B is the weight in kilograms (Kg) of each of the rechargeable batteries, and dr is the percentage (%) depth of discharge allowable for the rechargeable batteries so as not to shorten battery life.

4. The heating system according to claim 3, wherein each of the rechargeable batteries has a maximum recharge time of $t_r$ hours, which is equal to the number of reserve batteries multiplied by the discharge time $t_d$ in hours of each of the rechargeable batteries.

* * * * *